US006568563B2

(12) United States Patent
Ma et al.

(10) Patent No.: US 6,568,563 B2
(45) Date of Patent: May 27, 2003

(54) CLOSURE HAVING WELL WITH REMOVABLE MEMBRANE

(75) Inventors: Mike Xiaoli Ma, San Jose, CA (US); Brian M. Adams, Newark, CA (US); Alan W. Kieler, Batavia, IL (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

(21) Appl. No.: 09/930,024

(22) Filed: Aug. 14, 2001

(65) Prior Publication Data

US 2003/0071089 A1 Apr. 17, 2003

(51) Int. Cl.[7] ..... B67D 5/00
(52) U.S. Cl. ..... 222/83; 222/541.9
(58) Field of Search ..... 222/88, 129, 153.14, 222/83, 541.9; 141/330, 363; 220/254, 270; 215/253, 254, 303

(56) References Cited

U.S. PATENT DOCUMENTS

| | | | | |
|---|---|---|---|---|
| 3,209,934 A | | 10/1965 | Salminen | |
| 3,392,860 A | | 7/1968 | Faulstich | |
| 3,392,862 A | | 7/1968 | Faulstich | |
| 3,840,137 A | | 10/1974 | Faulstich | |
| 3,979,002 A | | 9/1976 | Faulstich | |
| RE29,850 E | * | 11/1978 | Labarre | 222/541.9 |
| 4,884,707 A | | 12/1989 | Crisci | |
| 4,911,316 A | | 3/1990 | Tackles | |
| 5,121,846 A | | 6/1992 | Adams et al. | |
| 5,232,125 A | | 8/1993 | Adams | |
| 5,370,270 A | | 12/1994 | Adams et al. | |
| 5,513,763 A | | 5/1996 | Adams et al. | |
| 5,662,231 A | | 9/1997 | Adams et al. | |
| 5,687,865 A | | 11/1997 | Adams et al. | |
| 5,687,867 A | * | 11/1997 | Lamoureux | 215/303 |
| 5,868,281 A | | 2/1999 | Bietzer et al. | |
| 5,909,827 A | | 6/1999 | Bietzer et al. | |
| 6,102,226 A | | 8/2000 | Verderber | |
| 6,177,041 B1 | | 1/2001 | Bietzer | |
| 6,231,491 B1 | | 5/2001 | Adams et al. | |
| 6,237,790 B1 | | 5/2001 | Verderber | |

* cited by examiner

*Primary Examiner*—Philippe Derakshani
(74) *Attorney, Agent, or Firm*—Dorsey & Whitney LLP

(57) ABSTRACT

A closure for a container neck having a crown, a reduced diameter portion, a downward facing shoulder, and an enlarged diameter portion. The crown defines an opening and an outwardly extending locking bead. The closure includes a cap, a skirt, a well, a frangible membrane, a pull ring, and a retainer. The skirt depends from the top and is adapted to fit around the crown and the enlarged diameter portion of the container neck. The well includes an upper side wall depending from the top, an inwardly directed shoulder located adjacent a bottom of the upper wall, and a lower side wall depending from the inwardly directed shoulder. The lower side wall has an interior surface and the lower side wall terminating at an open bottom. The frangible membrane in the well closes off the well and includes a line of weakness frangibly connecting the frangible membrane to the lower side wall adjacent the inwardly directed shoulder. The pull ring is attached to an upper surface of the frangible membrane. The pull ring is positioned within a recess and substantially below the top. The retainer structure is adapted to engage the downward facing shoulder of the container neck. The retainer structure includes a plurality of inwardly and upwardly extending retainer flap that engage the downward facing shoulder of the neck. The retainer structure further includes a hinge connecting each flap to an internal surface of the skirt.

19 Claims, 4 Drawing Sheets

CLOSURE HAVING WELL WITH REMOVABLE MEMBRANE

BACKGROUND OF THE INVENTION

1. Field of the Invention

The present invention relates to a new and improved closure for containers of the type used on water dispensers and water coolers. More particularly, the present invention is directed to a closure including a central well having a tamper-evidencing frangible membrane. The present invention is also directed to a closure including an improved retention structure for securing the closure to a neck of a container.

2. Description of Related Art

U.S. Pat. No. 5,370,270 to Adams et al. discloses a non-spill bottle cap used with conventional large liquid containers for water dispensers. The disclosed bottle cap is a snap-on type cap which may be applied to a large liquid container, for example, a five gallon water bottle, using conventional capping equipment. The disclosed bottle cap includes a well formed therein for receiving a dispenser tube of a water dispenser as the liquid container is inverted and mounted on a water dispenser. As disclosed in the Adams '270 patent, liquid within the container can be discharged through the dispenser tube once the container is mounted on the water dispenser and the dispenser tube extends through the well. Upon removal of the container from the water dispenser, the non-spill bottle cap reseals as the dispenser tube is removed from the well. Hence, the disclosed non-spill bottle cap prevents leakage of any liquid which may remain in the container as the container is removed from the dispenser.

Non-spill bottle caps, including the non-spill cap disclosed by the Adams '270 patent, are generally provided with a tamper-evident label. In particular, a label is applied to the top of a to prevent dirt or liquids from entering the well of the cap thus providing sanitary protection for the cap. Additionally the label may contain indicia such as the name of the bottler and any other information required by law or of other interest. Presence of the label on the cap provides some evidence that the cap has not been tampered with. However, the label may be torn, violated, worn away, or otherwise damaged during shipping and handling. In this case, it will be more difficult for a consumer to determine whether the cap and/or the contents of the container has been tampered with. Furthermore, the tamper-evidencing feature of the label is nullified in the event that another similar label is affixed to the cap after the cap and/or contents of the container has been tampered with.

Bottle caps, including the non-spill cap disclosed by the Adams '270 patent, are generally provided with a tension ring or locking bead designed to engage below a crown of a container neck to secure the bottle cap to the container neck. Such locking beads are generally a solid ring encircling the interior of a skirt of the cap. Generally a line of weakness is provided allowing a user to tear through the skirt and remove the bottle cap from the container neck. In the event that a line of weakness is provided which extends above the locking bead, a user may disadvantageously find difficulty in tearing the skirt of the cap along the line of weakness through the locking bead.

In some cases, engagement between the tension ring or locking bead with the underside of the crown is inadequate to prevent an unscrupulous person from removing the cap from the bottle without tamper evidence damage to the cap.

In particular, unauthorized reuse of caps in an improper fashion is a major problem in some countries.

What is needed is a closure for a container neck which overcomes the above and other disadvantages of known closures.

SUMMARY OF THE INVENTION

In summary, one aspect of the present invention is directed to closure for a container neck of the type having a crown, a reduced diameter portion, a downward facing shoulder, and an enlarged diameter portion. The crown defines an opening and an outwardly extending locking bead. The closure includes a cap, a skirt, a well, a frangible membrane, a pull ring, and a retainer. The skirt depends from the top and is adapted to fit around the crown and the enlarged diameter portion of the container neck. The well includes an upper side wall depending from the top, an inwardly directed shoulder located adjacent a bottom of the upper wall, and a lower side wall depending from the inwardly directed shoulder. The lower side wall has an interior surface and the lower side wall terminates at an open bottom. The frangible membrane in the well closes off the well and includes a line of weakness frangibly connecting the frangible membrane to the lower side wall adjacent the inwardly directed shoulder. The pull ring is attached to an upper surface of the frangible membrane. The pull ring is positioned within the well. The retainer structure is adapted to engage the downward facing shoulder of the container neck. The retainer structure may include a plurality of inwardly and upwardly extending retainer flaps that engage the downward facing shoulder of the neck. A hinge connects each flap to an internal surface of the skirt.

Alternatively, the retainer structure may include a locking bead projecting radially inwardly from the internal surface of the closure skirt. The locking bead is adapted to engage the downward facing shoulder of the neck.

An object of the present invention is to provide a closure for a container having a tamper-evidencing frangible membrane which seals a well of the closure.

Another object of the present invention is to provide a closure for a container having an improved retention structure for securing the closure to a container neck.

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
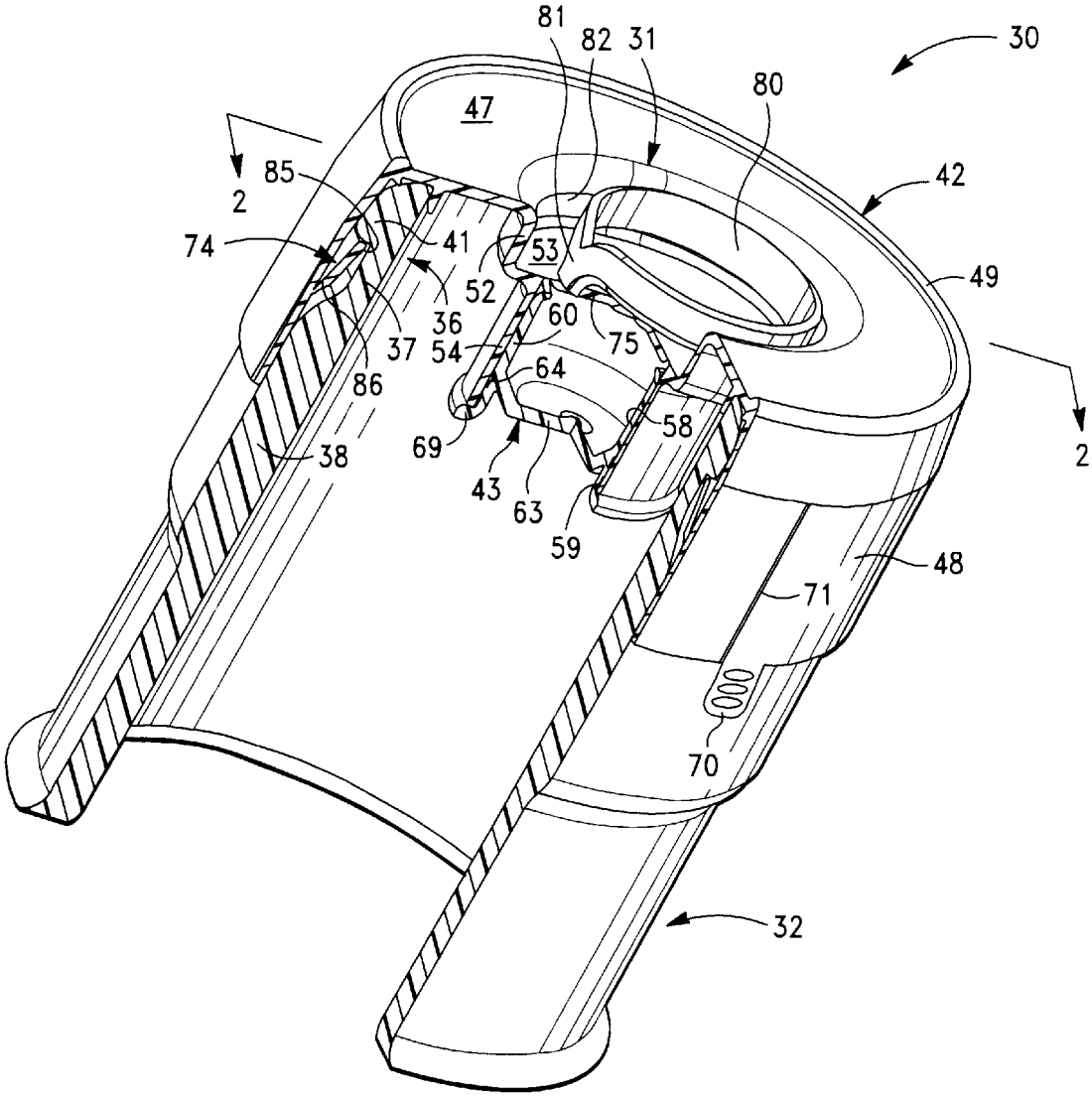
FIG. 1 is a perspective, partially sectioned view of a closure applied on a container neck in accordance with the present invention.

Turning now to the drawings, wherein like components are designated by like reference numerals throughout the various figures, attention is directed to FIG. 1. A closure in accordance with the present invention is particularly suited for use with a large container, for example, a five gallon water bottle conventionally used in the United States. The neck and shoulder of such a water bottle, when inverted, fits within a conventional water dispenser.

FIG. 1 shows a closure 30 in accordance with the present invention which incorporates a non-spill well 31 for use with a conventional water dispenser. Closure 30 is particularly suited for use with a container neck 32 of a large container generally having a crown 36, a reduced diameter portion 37 extending below crown 36, and an enlarged diameter portion 38 extending below reduced diameter portion 37. Crown 36 forms an outwardly radially extending neck bead 41. In the illustrated embodiment, neck bead 41 is a substantially solid bead which extends circumferentially around the opening of container neck 32. One should appreciate, however, that the closure of the present invention is equally suited for use with a crown flange of a blow molded container such as the type illustrated in U.S. Pat. No. 5,370,270 to Adams et al.

In one embodiment, closure 30 of the present invention generally includes a non-spill cap 42 and a cooperating plug 43, as shown in FIG. 1. Cap 42 includes a generally annular top 47, a central well 31, and a skirt 48 depending downwardly from a peripheral edge 49 of top 47. Skirt 48 is dimensioned to snugly fit around crown 36 and enlarged diameter portion 38 of container neck 32, the dimensions of which are fairly standardized in the water bottle industry. Closure 30 is formed of plastic and/or other suitable materials. Preferably, low density polyethylene is used in the construction of closure 30 in accordance with the present invention, however, one should appreciate that other suitable materials can be used. The material and the generally thin-walled construction of the closure, generally provide for a cap which tightly conforms to the container neck crown, as well as the lower enlarged diameter of container neck 32, as closure 30 is applied to the container.

As noted above, closure 30 of the present invention is provided with non-spill well 31. The non-spill well is dimensioned and configured to receive a dispenser tube commonly found on many water dispensers. Well 31 includes an upper side wall 52 depending from a central portion of top 47. An upward-facing shoulder 53 of well 31 extends inwardly from a bottom portion of upper side wall 52. Well 31 further includes a lower side wall 54 depending from well shoulder 53. Lower side wall 54 has an interior surface 58 and defines an open bottom aperture 59 of well 31.

Figure 2:
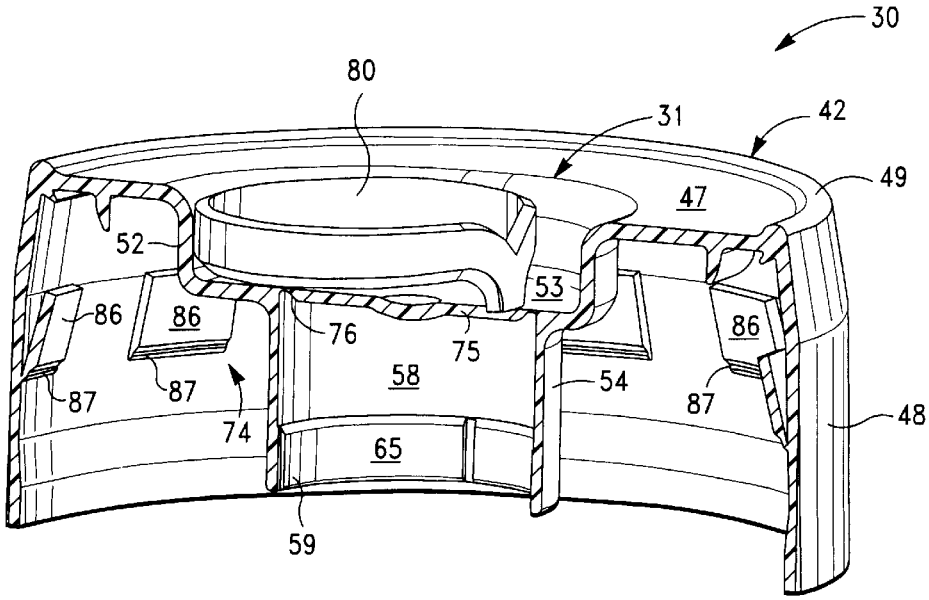
FIG. 2 is a cross-sectional perspective view of the closure shown in FIG. 1, without the container neck, taken substantially along line 2—2 of FIG. 1.

Open bottom aperture 59 is configured to be selectively closed, that is, selectively fluidly sealed by removable slidable plug 43. Plug 43 is dimensioned and configured to releasably engage a rounded closed upper end of the dispenser tube in a manner similar to that described in U.S. Pat. No. 5,370,270 to Adams et al., the entire contents of which is incorporated herein by this reference. Plug 43 has a cylindrical wall 60 and a closed disk 63 extending radially inward from cylindrical wall 60. As illustrated, closed disk 63 is positioned adjacent a bottom edge of cylindrical wall 60 and fluidly seals plug 43. One should appreciate that the closed disk can be positioned anywhere along the cylindrical wall such that the closed disk fluidly seals the plug. Alternatively, the plug can be formed of a solid cylindrical member provided the plug can be received within and engage the well. In either case, an exterior of plug 43 includes well engaging structure which extends radially outward from plug 43 to secure the plug when positioned within well 31 and to fluidly seal the well. As shown in FIG. 2, well 31 includes an inner bead 65 located adjacent the open bottom 59 of well 31. As shown in FIG. 1, plug 43 includes well engaging structure in the form of an outer shoulder 64. Outer shoulder 64 is detachably engageable with an inner bead 65 for fluidly sealing the well in the manner described above when plug 31 is seated within well 31.

Plug 43 further includes an outwardly extending annular flange 69 positioned adjacent a bottom edge of cylindrical wall 60. Annular flange 69 extends outwardly and contacts the bottom edge of lower side wall 54 and prevents plug 43 from being pushed through well 31.

As shown in FIG. 1, closure 30 of the present invention includes a release or pull tab 70 depending from a bottom edge of skirt 48. Pull tab 70 is provided with transverse finger grip ridges to facilitate a user gripping and pulling pull tab 70. A line of weakness 71 extends from the bottom edge of skirt 48 adjacent pull tab 70 and upwardly along and a portion of skirt 48. Line of weakness 71 further extends upwardly past a retainer structure 74 which extends radially inwardly from an interior surface of skirt 48. Although the embodiment of FIG. 1 only has one line of weakness, one should appreciate that additional lines of weakness can be provided in accordance the present invention to further facilitate tearing of skirt 48 to remove closure 30 from container neck 32.

Retainer structure 74 is dimensioned to engage a downward facing shoulder 85 formed by the intersection of neck bead 41 and reduced diameter portion 38 of container neck 32. Skirt 48 is dimensioned to fit tightly around container neck 32 including a portion of enlarged diameter portion 38, that is until a user pulls pull tab 70 and tears skirt 48 along line of weakness 71. In particular, by pulling upward on pull tab 70, skirt 48 tears along line of weakness 71 and thence along a sufficient portion of line of weakness 71 so that the lower portion of skirt 48 releases its grip on enlarged diameter portion 38 of container neck 32 and a sufficient portion of retainer structure 74 disengages neck shoulder of container neck 32. So long as line of weakness 71 is intact, and skirt 48 is intact on container neck, it is virtually impossible to remove cap 42 form container neck 32 without evidence of tampering. Once the lower portion of skirt 48 is loosened, the upper portion of cap 42 may be removed from container neck 32. Although the embodiment of FIG. 1 only has one line of weakness, one should appreciate that additional lines of weakness can be provided in accordance the present invention to further facilitate tearing of the skirt to remove the closure from the container neck.

It will be understood that in the preferred practice of the present invention, cap 42 is not removed prior to installation of the container in the dispenser, that is, a dispenser tube of a water dispenser engages plug 43 in order to provide access to the contents within the container. In particular, the exterior of the dispenser tube fits tightly against the inside bore of well 31 in a well known manner. However, many times a consumer may wish to use the container in a different type of dispenser, that is, one without a dispenser tube. In such instances, a consumer may pull release tab 70, tear skirt 48 along line of weakness 71, and remove closure 30 from the container before mounting the bottle on a water dispenser not having a dispenser tube. Alternatively, the consumer may dispense the water from the container by removing membrane 75 while leaving closure 30 attached to the container. In this case, closure 30 would be supplied without a plug.

Further, after the container has been returned to a bottling facility, it is necessary to remove closure 30 before the bottle is sterilized and refilled. Hence, pull tab 70 and line of weakness 71 can also be used for such purposes.

As most clearly shown in FIG. 2, a frangible membrane 75 closes off well 31. Frangible membrane 75 is frangibly connected to lower side wall 54 by a thin peripheral portion which forms a line of weakness 76 extending along the perimeter of frangible membrane 75. Preferably the frangible member is monolithically formed with cap 42. As illustrated, frangible membrane 75 is connected to lower side wall 54 adjacent well shoulder 53, however, one should appreciate that other configurations can be used in accordance with the present invention.

A pull ring 80 is attached to an upper surface of frangible membrane 75 by an upstanding post 81 in such a manner that a user may insert their finger through pull ring 80 to grip and pull it in order to tear frangible membrane 75 along line of weakness 76 and open well 31. In particular, when the user grips ring 80 and pulls upward, frangible membrane 75 tears along line of weakness 76 allowing the user to remove frangible membrane 75 from closure 30. As illustrated, pull ring 80 is positioned within a recess 82 which is formed by upper side wall 52, well shoulder 53 and frangible membrane 75. As illustrated, recess 82 is oblong, however, one should appreciate that the recess can be substantially round or of other geometric shapes in accordance with the present invention. For example, the recess can have a frustoconical shape thus providing more room to facilitate a user gripping pull ring 80. The illustrated pull ring 80 is also positioned substantially below top 47. Again, one should appreciate that other configurations can be used, for example, the pull ring may be positioned such that some or all of the pull ring extends above the top.

Closure 30 shown in FIG. 1 also includes a new and improved retainer structure 74 adapted to engage neck shoulder 85 which is formed by the intersection of crown 36 and reduced diameter portion 37 of container neck 32. Retainer structure 74 includes a plurality of inwardly and upwardly extending retainer flaps 86 circumferentially spaced around an internal surface of skirt 48. Each flap 86 engages a portion of neck shoulder 85 and prevents removal of cap 42 from container neck 32 until a portion of skirt 48 is removed. A hinge 87 connects each flap 86 to the internal surface of skirt 48. Retainer flaps 86 and hinges 87 are monolithically formed with cap 42.

Figure 3:
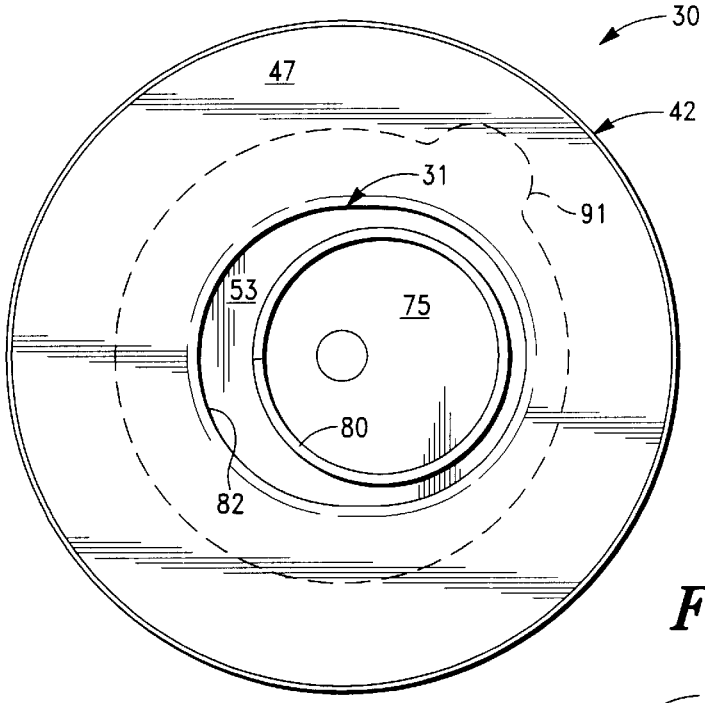
FIG. 3 is a top plan view of the closure shown in FIG. 1.

For identifying purposes and/or further tamper-evident purposes a label 91, illustrated in phantom in FIG. 3, can be adhered to top 47 of closure 30. Labeling information such as the name of the bottler and information as to the contents of the container may be printed on the label. Further, the label covers well 31 and prevents dirt, liquids or other contaminants from entering well 31. Additionally, the label can be a further tamper-evidencing feature as once it is removed it provides evidence that someone may have tampered with the pull ring and/or the frangible membrane within the well of the closure.

In operation and use, the closure of the present invention, including cap and plug, can be shipped as a unit from a cap manufacturing facility. Closure 30 can be snapped onto a container neck in the same manner and by the same equipment as used with conventional caps and necks. Closure 30 is tamper-evident, in part, because retainer structure 74 of closure 30 engages container neck 32 and prevents closure 30 from being removed from container neck 32 until skirt 48 of closure 30 is torn by a user. Closure 30 is also tamper-evident, in part, because detachable membrane prevents tampering with plug 43 and thus prevents tampering with the contents of the container until the detachable membrane is removed from well 31 by a use. One should appreciate that further evidence of tampering may be afforded by the presence or absence of plug. Only by use of a dispenser may plug 43 be re-positioned in well once it has been removed.

Upon delivery of the container including bottled liquid to the site of the dispenser, closure 30 remains on the neck of the container. The container is inverted and lowered into the dispenser. The container remains sealed and hence liquid does not spill from the container during the period of time when the container is being lowered into the dispenser. As a user inverts the container and further lowers into the dispenser, a dispenser tube contacts the bottom edge of plug 43 and engages plug 43 in a well known manner illustrated in U.S. Pat. No. 5,370,270, the entire contents of which is incorporated herein by this reference.

As closure 30 and container are lowered into the water dispenser, plug 43 is forced upwardly out of well 31. Once plug 43 is pushed from well 31, the dispenser tube is in fluid communication with the interior of the container and liquid can flow through the dispenser tube into the water dispenser. It will be noted that plug 43 is firmly gripped on the upper end of the dispenser tube, in a manner similar to that illustrated in the '270 patent, and plug 43 does not float inside the container.

After the contents of the container have been wholly or partially dispensed, the user may remove the container from the water dispenser. This operation is the reverse of the above described operations. That is, the container is lifted from the water dispenser. Because plug 43 is detachably engaged with the dispenser tube, plug 43 is pulled back into well 31 and engages the side wall of the well. The outwardly extending annular flange contacts the bottom edge of lower side wall 54 of well 31 and thus prevents plug 43 from being pushed through well 31. Once plug 43 snaps in place and re-engages well 31 of closure 30, plug 43 prevents leakage of any liquid remaining in the container while the container is being removed from the water dispenser and returned to upright position.

When the container is returned to the cap manufacturing facility, closure 30 is generally removed by automatic de-capping equipment known in the art. Alternatively, a bottling plant employee may grip pull tab 70 and tear skirt 48 along line of weakness 71. This permits closure 30 to be removed from the container so that the container may be sterilized, refilled and then recapped.

One of the advantages of the present invention is the fact that closure 30 may be used with conventional containers and no special containers are required. Still another advantage of the present invention is the fact that when a filled container is used with a dispenser other than that with which it is primarily intended, closure 30 may be removed by the consumer while the container is in an upright position by gripping the tear tab and tearing the bottom of skirt 48 and then removing the upper portion of the cap and closure 30.

Figure 4:
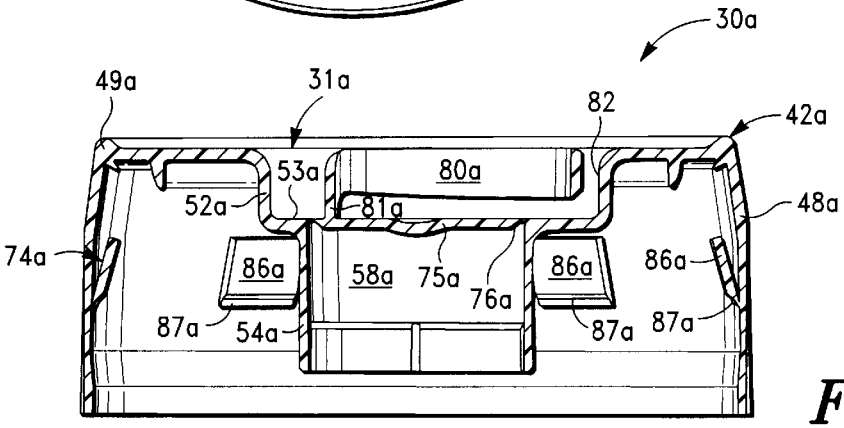
FIG. 4 is a cross-sectional side view of a closure similar to that shown in FIG. 1 in accordance with the present invention having a modified retaining structure.
Figure 5:
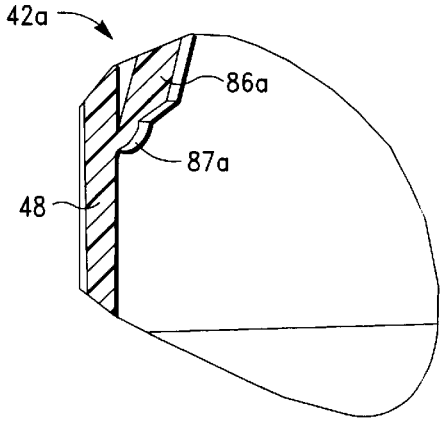
FIG. 5 is an enlarged cross-sectional detailed view of a portion of the closure shown in FIG. 4 including the retaining structure of FIG. 4.

FIGS. 4 and 5 show another embodiment in accordance with the present invention having a closure 30*a*. Like reference numerals have been used to describe like components of closures 30 and 30*a*. Cap 32*a* is substantially the same as cap 32 of the previous figures but includes fewer retention flaps 86 than in the previous embodiment. Although the illustrated caps 32 and 32*a* include twelve and six flaps, respectively, one should appreciate that any number of flaps can be used in accordance with the present invention.

Figure 6:
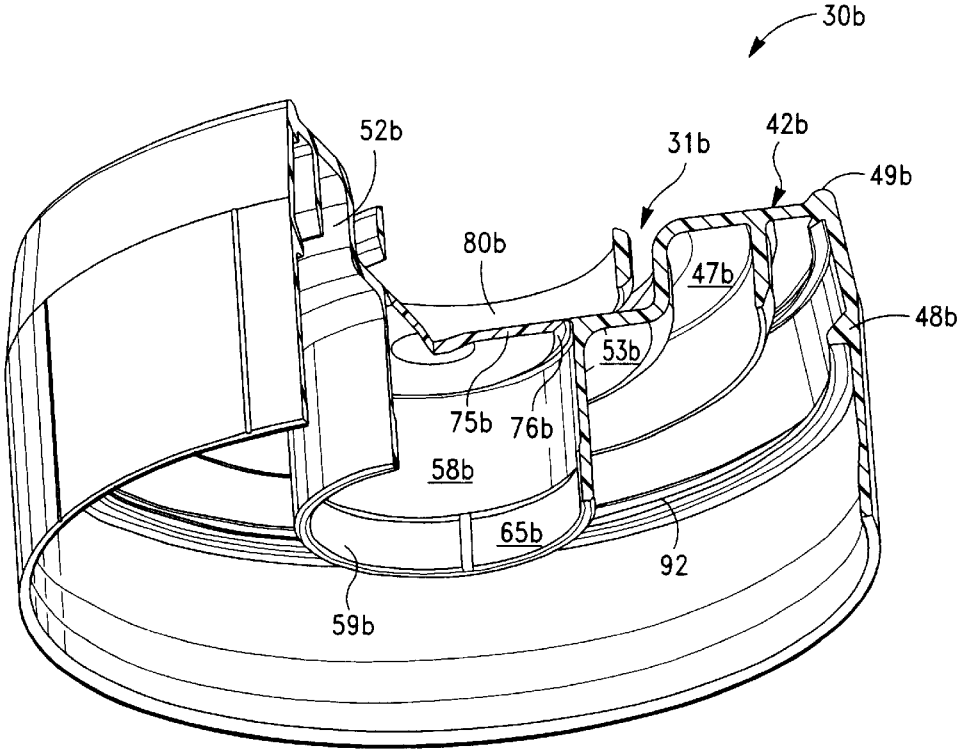
FIG. 6 is a perspective, partially sectioned view of a modified closure, similar to that shown in FIG. 1, without the container neck, the closure having a modified retaining structure in accordance with the present invention.

FIG. 6 shows another embodiment in accordance with the present invention having a closure 30*b*, wherein like reference numerals have again been used to describe like components. Cap 32*b* is substantially the same as cap 32 of the previous figures but includes a continuous retaining bead 92 instead of retaining flaps. Retaining band 92 extends radially inwardly from an interior surface of skirt 48*b*. Retaining bead 92 is dimensioned to engage downward facing shoulder 75 of container neck 32 in a similar manner as retaining structure 74, as described above.

Figure 7:
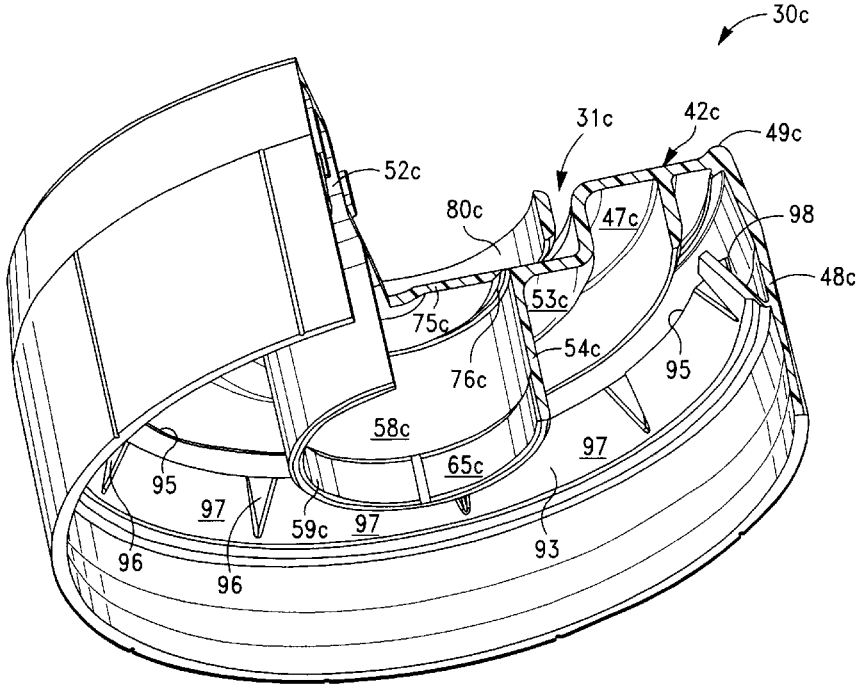
FIG. 7 is a perspective, partially sectioned view of a modified closure, similar to that shown in FIG. 1, without the container neck, the closure having a modified retaining structure in accordance with the present invention.

FIG. 7 shows another embodiment in accordance with the present invention having a closure 30*c*, wherein like reference numerals have again been used to describe like components. Cap 32*c* is substantially the same as caps 32 and 32*b* of the previous figures, however, cap 32*c* includes a retaining structure in the form of an essentially continuous, upward-inward directed retaining band 93. Retaining band 93 is dimensioned to engage downward facing shoulder 75 of container neck 32 in a similar manner as retaining structure 74 and retaining bead 92, as described above.

Retaining band 93 includes an upper edge 95 as well as a plurality of circumferentially spaced pleats or flutes 96 separating an equal number of arcuate portions 97 therebetween. Arcuate portions 97 have a radius of curvature that approximates the curvature of reduced diameter portion 37 of container neck 32 so that when closure 30*c* is mounted onto container neck 32, upper edge 95 of arcuate portions 97 firmly engage neck shoulder 85 of container neck 32. In particular, the inwardly turned retaining band 93 extends at least partially upwardly so that its upper free edge 95 faces upwardly and is positioned to engage neck shoulder 85 of container neck 32.

Flutes 96 are pleated radially outwardly of arcuate portions 97 such that each flute 96 folds outwardly between adjacent arcuate portions 97 and toward an inner surface of depending skirt 48*c*. Each flute 96 includes a vertex 98 that is spaced a distance outwardly of adjacent arcuate portions 97 and that is proximal the inner surface of skirt 48*c*. Preferably, the depth of flutes 96 is sufficient that the outer extremity or vertex 98 of each flute 96 remains underneath neck shoulder 85 of container neck 32 when closure 30*c* is mounted on the container neck. One should appreciate, however, that vertex 98 need not remain underneath neck shoulder 85 provided that the overall configuration of the flutes biases and positions the upper edge of arcuate portions 97 and a portion of the upper edge of flutes 96 into engagement with neck shoulder 85 of container neck 32.

Advantageously, the retaining rim or band of the present invention can also provide a further tamper-evidencing feature. In particular, the configuration of retaining band 93 ensures that at least a majority of upper edge 95 of retaining band 93 engages neck shoulder 85. Even in the event that an unscrupulous person attempts to remove closure 30 from container neck 32 by using a flat edge tool, such as standard screwdriver or similar means, the configuration of retaining band 93 minimizes and/or prevents the person from prying enough of retaining band 93 outwardly of container neck 32 to slip closure 30*c* from container neck 32. Furthermore, because retaining band 93 extends inwardly from an inner surface of skirt 48*c* intermediate top 47*c* and the bottom edge of skirt 48*c* into a recess formed between enlarged diameter portion 38 and crown 36 of the container neck, retaining band 93 is not readily visible thus making it more difficult for a person to attempt to circumvent the tamper-evidencing feature thereof.

Although the illustrated embodiment includes a number of flutes, one should appreciate that retaining band 93 can include two or more flutes in accordance with present invention so long as the design allows the upper edge of retaining band 93 to expand around crown 36 of container neck 32 as closure 30*c* is applied to the container neck.

Figure 8:
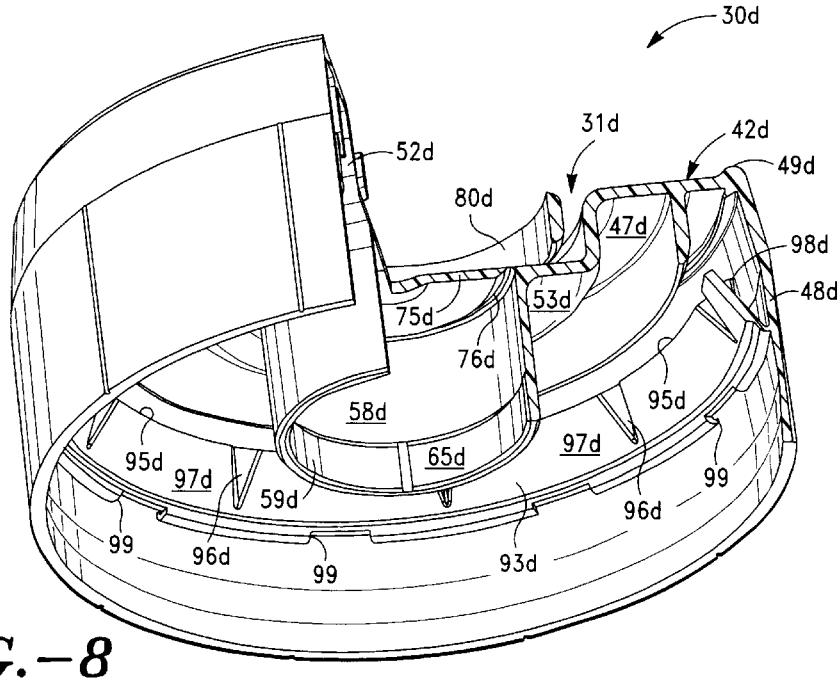
FIG. 8 is a perspective, partially sectioned view of a modified closure, similar to that shown in FIG. 1, without the container neck, the closure having a modified retaining structure in accordance with the present invention.

FIG. 8 shows another embodiment in accordance with the present invention having a closure 30*d*, wherein like reference numerals have again been used to describe like components. Cap 32*d* is substantially the same as cap 32*c* of the previous figures but includes circumferentially spaced apertures 99 located in a bottom portion of retaining band 93*d* adjacent the inner surface of skirt 48*d*. Apertures 99 prevent fluids and other substances from collecting in the upwardly facing groove formed between the upper surface of retaining band 93*d* and in inner surface of skirt 48*d*.

The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

For convenience in explanation and accurate definition in the appended claims, the terms "up" or "upper" and "down" or "lower" to describe features of cap and plug refer to the positions of those members displayed in FIGS. 1–5 and respectively.

In many respects the modifications of the various figures resemble those of preceding modifications and the same reference numerals followed by subscripts a, b, c and d designate corresponding parts.

The foregoing descriptions of specific embodiments of the present invention been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A closure for use with a container neck having a crown, said closure comprising:

a top;

a skirt depending from a peripheral portion of said top and adapted to fit around a portion of the container neck;

a retainer adapted to engage the container crown, said retainer extending radially inward from an interior surface of said skirt;

a well including a side wall depending downwardly from a central portion of said top, said side wall having an interior surface and a bottom; and a removable membrane frangibly connected to said interior surface of said side wall below said top and closing off said well.

2. A closure for use with a container neck having a crown, said closure comprising:

atop;

a skirt depending from a peripheral portion of said top and adapted to fit around a portion of the container neck;

a retainer adapted to engage the container crown, said retainer extending radially inward from an interior surface of said skirt;

a well including a side wall depending downwardly from a central portion of said top, said side wall having an interior surface and a bottom; and a removable membrane frangibly connected to said interior surface of said side wall below said top and closing off said well;

wherein said well bottom is an open bottom and said well includes an inner bead located adjacent said open bottom, said closure further comprising a plug including an exterior detachably engageable with said inner bead for fluidly sealing said well when said plug is seated within said well.

3. The closure according to claim 2 wherein said plug exterior comprises an outer shoulder engageable with said inner bead.

4. The closure according to claim 1 further comprising a release tab depending from said skirt and a line of weakness extending from said release tab and along a portion of said skirt, said cap skirt being adapted to fit tightly around the container neck until a user pulls said release tab and tears said skirt along said line of weakness.

5. The closure of claim 1 further comprising a line of weakness frangibly connecting said removable membrane to said side wall.

6. The closure of claim 1 further comprising a pull ring attached to an upper surface of said removable membrane.

7. The closure of claim 6 wherein said pull ring is positioned within said well.

8. The closure of claim 2 further comprising a line of weakness frangibly connecting said removable membrane to said lower side wall.

9. The closure of claim 2 further comprising a pull ring attached to an upper surface of said,removable membrane.

10. The closure of claim 9 wherein said pull ring is positioned within said well.

11. A closure for use with a container neck including a crown having an outwardly extending locking bead, a reduced diameter portion below the crown, a downward facing shoulder defined by the intersection of the locking bead and the reduced-diameter portion, the closure comprising:

a top;

a skirt depending from a peripheral portion of said top and adapted to fit around said crown and said enlarged diameter portion of said neck; and a retainer adapted to engage said downward facing shoulder, said retainer including an inwardly and upwardly extending retainer member adapted for engaging the downward facing shoulder of the neck, and a hinge connecting said retainer member to an internal surface of said skirt.

12. The closure of claim 11 wherein said retainer includes a plurality of circumferentially spaced retainer members.

13. The closure of claim 11 wherein said retainer includes a plurality of circumferentially spaced flaps.

14. The closure of claim 11 wherein said flap is monolithically formed with said skirt.

15. The closure of claim 11 wherein said retainer member is monolithically formed with said skirt.

16. A closure for use with a container neck including a crown having an outwardly extending locking bead, a reduced diameter portion below the crown, a downward facing shoulder defined by the intersection of the locking bead and the reduced-diameter portion, the closure comprising:

a top;

a skirt depending from a peripheral portion of said top and adapted to fit around said crown and said enlarged diameter portion of said neck; and a retainer adapted to engage said downward facing shoulder, said retainer including an inwardly and upwardly extending flap adapted for engaging the downward facing shoulder of the neck, and a hinge connecting said flap to an internal surface of said skirt;

wherein said retainer comprises a plurality of circumferentially spaced inwardly and upwardly extending retainer flaps and a hinge connecting each flap to a respective portion of said internal surface of said skirt.

17. The closure of claim 16 wherein said retainer includes a plurality of circumferentially spaced flaps.

18. The closure of claim 16 wherein said flap is monolithically formed with said skirt.

19. In combination, a closure and a neck for a container, said neck comprising:

a crown defining an opening and an outwardly extending locking bead, a reduced diameter portion below said crown, a downward facing shoulder defined by the intersection of said locking bead and said reduced-diameter portion, and an enlarged diameter portion below said reduced diameter portion, said closure comprising:

a cap having a top, a skirt depending from a peripheral portion of said top and adapted to fit around said crown and said enlarged diameter portion of said neck, a well including an upper side wall depending from a central portion of said top, an inwardly directed, inwardly extending shoulder located adjacent a bottom of said upper wall, a lower side wall depending from said inwardly directed shoulder, said upper side wall and said inwardly directed shoulder forming a recess, said lower side wall having an interior surface and said lower side wall terminating at an open bottom of said well, a frangible membrane in said well closing off said well, said frangible membrane including a line of weakness frangibly connecting said frangible membrane to said lower side wall adjacent said inwardly directed shoulder, a pull ring attached to an upper surface of said frangible membrane, said pull positioned within said recess and substantially below said top, a retainer adapted to engage said downward facing shoulder, said retainer including an inwardly and upwardly extending retainer flap engaging said a downward facing shoulder of said neck, and a hinge connecting said flap to an internal surface of said skirt.

* * * * *